United States Patent [19]

Fritz et al.

[11] 4,285,328

[45] Aug. 25, 1981

[54] AGRICULTURAL WASTE BURNING HEATER AND HEATING METHOD

[76] Inventors: William J. Fritz, 1672 16th Ave.; James A. Fritz, 4023 E. 8th; Lawrence D. Fritz, R.R. 5, Box 27AB, all of Columbus, Nebr. 68601

[21] Appl. No.: 16,279

[22] Filed: Feb. 28, 1979

[51] Int. Cl.[3] ..... F23G 7/00

[52] U.S. Cl. ..... 126/225; 110/315; 110/346; 126/76

[58] Field of Search ..... 110/196, 197, 216, 217, 110/235, 251, 252, 259, 315, 323, 346, 248; 126/224, 225, 76

[56] References Cited

U.S. PATENT DOCUMENTS

| | | | |
|---|---|---|---|
| 116,237 | 7/1897 | McLean | 126/76 X |
| 376,076 | 1/1888 | Daly | 126/225 |
| 1,044,724 | 11/1912 | Atteberry | 126/76 |
| 2,538,811 | 1/1951 | Triggs | 110/235 |
| 4,048,927 | 9/1977 | Mallek et al. | 110/217 X |
| 4,206,804 | 6/1980 | Scholtes et al. | 126/67 |

*Primary Examiner*—Charles A. Ruehl
*Attorney, Agent, or Firm*—Shlesinger, Arkwright, Garvey & Dinsmore

[57] ABSTRACT

A heater which burns agricultural waste as its heat source includes a combustion chamber for the waste having a bottom opening, a grate for supporting the waste, an access lid at the top and an air intake at or adjacent the top. The bottom opening is connected to an exhaust system which includes a fan for creating a downward draft in the combustion chamber causing the exhaust gas stream to leave the chamber at the bottom opening. The exhaust system also includes elements for the removal of solid combustion products from the exhaust stream and for regulating the temperature of the exhaust stream which is then usable for heating purposes.

20 Claims, 4 Drawing Figures

10
12
14
16
18
20
22
24
26
32
34
36
38
40
42
44
46
48
50
52
54
56
58
60
62
64
66
68
70
72
74
80

AGRICULTURAL WASTE BURNING HEATER AND HEATING METHOD

BACKGROUND OF THE INVENTION

This invention concerns an apparatus and method for burning agricultural waste, particularly straw, which will produce a more efficient combustion resulting in more heat output and a cleaner exhaust stream, the hot gases of which may be put to use as a heat source.

Although alternative energy sources have only recently received a significant amount of attention, consideration of the burning of straw and other agricultural waste as a useful energy source goes back many years. An efficient agricultural waste burner as a heat source would be particularly useful in agricultural operations requiring heat since the fuel would be readily at hand. However, two major difficulties occur with the burning of straw. Straw forms a large amount of loose ash which must be removed at frequent intervals and straw burning requires a large amount of monitoring and, consequently, a large amount of operator time.

SUMMARY OF THE INVENTION

An object of this invention is to provide an agricultural waste burning apparatus and method which will efficiently burn straw and/or other forms of agricultural waste to produce a high heat energy output.

Another object of this invention is to provide an agricultural waste burning apparatus and method which will serve as a heat energy source while requiring relatively little operator monitoring.

A further object of this invention is to provide an agricultural waste burning apparatus and method which will supply heat while producing a clean exhaust and a relatively small amount of ash.

Another object of this invention is to provide an agricultural waste burning apparatus and method which will produce a hot exhaust gas stream sufficiently clean to be usable for heating purposes.

The heater apparatus comprises a combustion chamber for agricultural waste having an opening at the bottom and an access at the top for the addition of waste material. The heater includes a support in the combustion chamber for the waste which will not obstruct gas flow through the chamber, an exhaust system connected to the bottom opening, an air intake mechanism in the upper part of the combustion chamber permitting air flow into the combustion chamber and a gas flow generating mechanism for creating a downward draft in the combustion chamber which exits the chamber at the bottom opening and passes through the exhaust system whereby agricultural waste burned in the combustion chamber while being subjected to the downward draft is almost completely combusted producing a stream of hot gases which is usable for heating purposes upon leaving the exhaust system. The exhaust system includes an element or elements for the removal of solid combustion products from the exhaust gas stream. The exhaust system may also include an air mixing mechanism for the addition of cooler air to the hot exhaust gas to regulate the final temperature of the gas stream leaving the exhaust system.

The heater may be partially enclosed in a housing which serves to create an air space which functions to trap escaping heat. The exhaust system may also include a bypass conduit for disposing of the exhaust gas stream outside the heater during start up.

The method comprises placing agricultural waste in a combustion chamber having an opening at the bottom and an air intake means in the upper part thereof, burning the agricultural waste while maintaining a downward draft in the combustion chamber, removing solid combustion products from the resultant exhaust gases coming from the bottom of the combustion chamber, and using the exhaust gas stream for heating purposes.

DETAILED DESCRIPTION OF THE INVENTION

Figure 1:
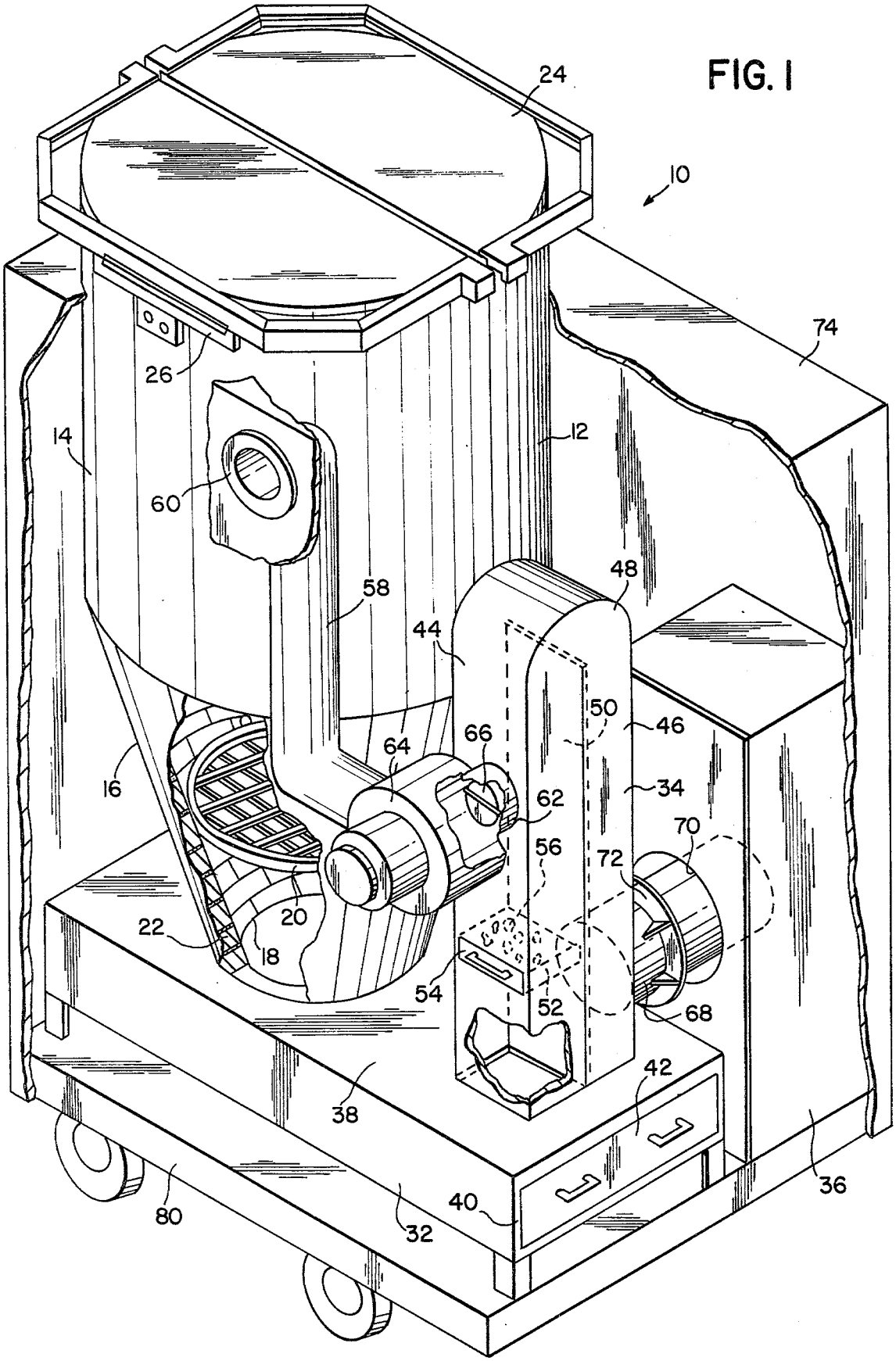
FIG. 1 is a perspective view of a heater embodying the invention partially broken away to show interior details.
Figure 3:
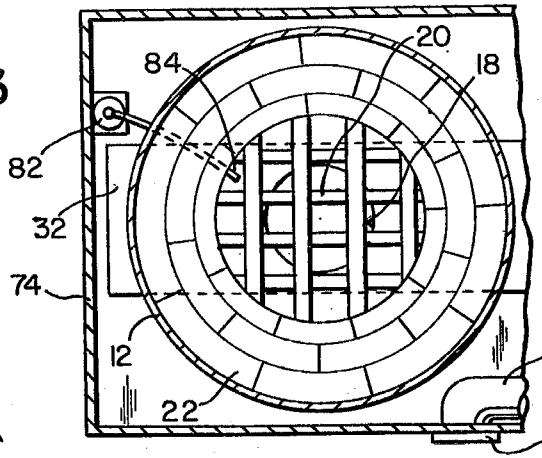
FIG. 3 is a sectional view taken along the line 3—3 of FIG. 2 and viewed in the direction of the arrows.
Figure 4:
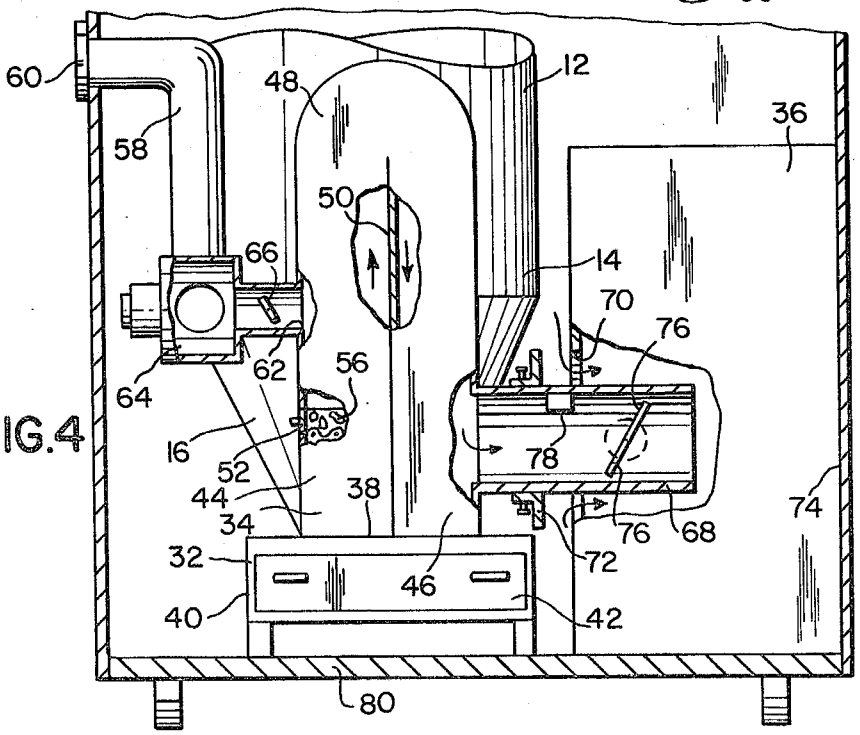
FIG. 4 is a sectional view taken along the line 4—4 of FIG. 2 and viewed in the direction of the arrows.
Figure 2:
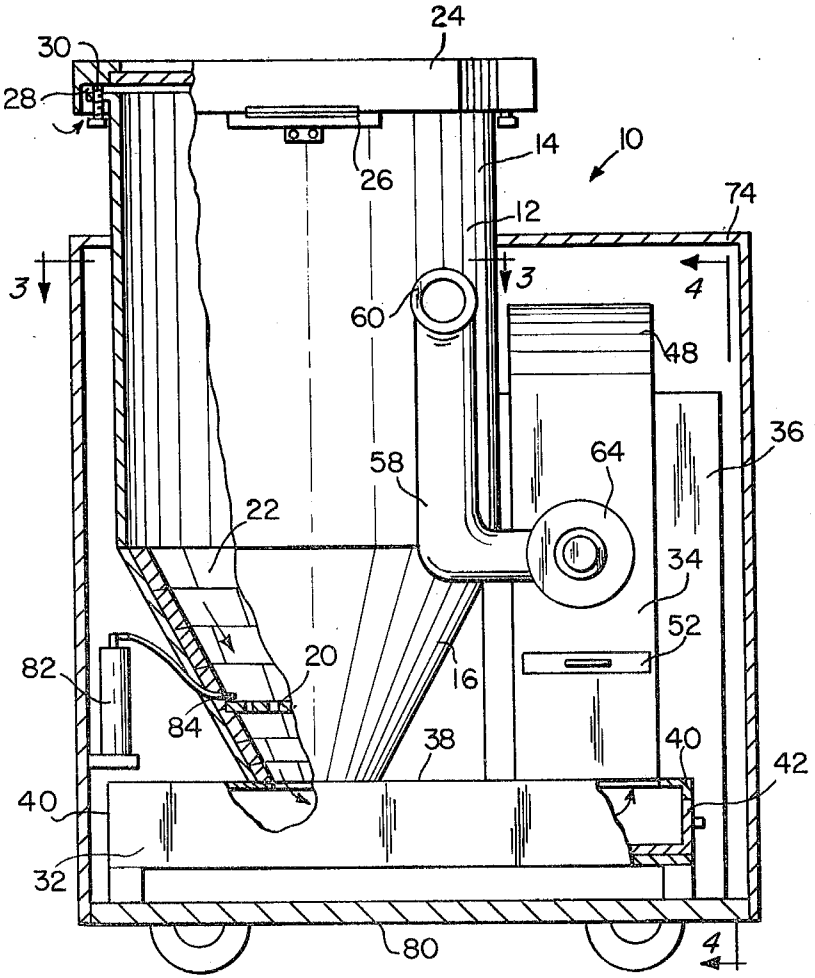
FIG. 2 is a side elevational view partially in section showing the heater of FIG. 1.

Referring to the figures, the heater 10 has a generally vertically disposed combustion chamber or container 12 for agricultural waste material which is preferably straw but which also may be hay, cornstalks, corn cobs, wood shavings, wood chips, and/or sawdust. The combustion chamber 12, which may be varied in size according to the material burned, has a generally cylindrical upper portion 14 and a generally conical lower portion 16 which tapers downwardly toward a circular bottom opening 18. Situated in the conical lower portion 16 is a generally horizontally disposed grate 20 which supports the waste material and prevents it from falling through the bottom opening 18. The support 20 is preferably a grate or screen so as to permit gas flow through the combustion chamber 12. The conical lower portion 16 is lined with firebrick 22.

Located at the top of the upper portion 14 of the combustion chamber 12 is a cover or lid 24 which provides access to the combustion chamber 12 for the addition of more waste material as the agricultural waste already in the combustion chamber 12 is consumed. The lid 24, which when closed is generally horizontally disposed across the top of the combustion chamber 12, comprises two halves each connected to a hinge 26 by which the lid 24 is opened or closed. Alternatively, the lid 24 may be designed to be simply lifted off the top of the combustion chamber 12 when access to the interior of the combustion chamber 12 is desired or any appropriate mechanism for the opening and closing of the lid 24 may be provided.

Situated in the upper part of the combustion chamber 12 is an air intake 28 which permits air flow into the combustion chamber 12. While the air intake 28 need not necessarily be a part of the access lid structure 24, in the heater 10 the air intake 28 comprises a gap established between the lid 24 and the top of the cylindrical upper portion 14 of the combustion chamber 12. This gap is maintained by a plurality of projections 30 extending upward from the top of the combustion chamber 12 upon which the halves of the lid 24 rest. The gap is made adjustable by the use of threaded bolts for the projections 30 which can be turned to raise or lower the lid 24. Thus the air flow into the combustion chamber 12 may be regulated.

As will be explained below, exhaust gas flow from the combustion occurring in the chamber 12 is downward out the bottom opening 18. The bottom opening 18 feeds the exhaust gases into an exhaust system having an exhaust chamber 32, a separation tower 34 and a fan (not shown) contained in a fan housing 36. From the fan housing 36 the gas stream is directed to an exhaust outlet (not shown). The exhaust chamber 32 is situated at the base of the combustion chamber 12 with the bottom opening 18 of the combustion chamber 12 being situated in the top 38 of the exhaust chamber 32. The exhaust chamber 32 is generally rectangular in shape having in addition to the top 38 side panels 40 which have at least one access port 42. A second access port (not shown) may be located in the side panel opposite the first access port 42.

An exhaust conduit extends from the exhaust chamber 32 to the exhaust outlet (not shown) and includes the separation tower 34 and the fan housing 36. The separation tower 34 comprises two generally vertically disposed conduit portions 44, 46. The first vertical portion 44 extends upwardly from the top 38 of the exhaust chamber 32 to which it is directly connected and ends in a semi-circular shaped conduit member 48 which is in turn connected to the second vertical portion 46. The two vertical portions 44, 46 are adjacent one another and have a common wall 50.

A filter 52 is located in the first vertical portion 44 of the tower 34. The filter 52 comprises a generally horizontally disposed support 54 such as a grate or screen having a layer of filtration material 56 such as cinders or clinkers positioned thereon. The filter 52 may be structured as a drawer which can be slid out of the generally vertical portion 44 to change the clinkers or cinders 56.

Connected to the exhaust system is a bypass conduit 58 which has an outlet 60 emptying outside the apparatus 10 and an inlet 62 located in the first generally vertical portion 44 of the tower 34 between the filter 52 and the top of the first vertical portion 44. The bypass conduit 58 includes a fan 64 for generating flow through the bypass conduit 58 and a damper 66 for isolating the bypass conduit 58 from the first vertical portion 44.

A generally horizontally oriented conduit 68 extends from adjacent the base of the second vertical portion 46 of the tower 34 into the fan housing 36. The fan housing 36 has a greater cross sectional area than the horizontal conduit 68. An annular inlet port 70 is situated in the wall of the fan housing 36 and surrounds the conduit 68 at its point of connection with the fan housing 36. An annular member or flange 72 functioning as the inlet port cover is mounted about the conduit 68 and is longitudinally movable along the conduit 68 to vary the size of the inlet port opening 70. The inlet port opening 70 may have access directly to the ambient air but in the heater 10 is exposed to the air space contained within the housing 74. The housing 74 encloses at least a portion of the heater apparatus 10 and serves to create an air space which functions to trap escaping heat. In the embodiment of FIG. 1 the housing 74 encloses the entire apparatus 10 excepting an upper part of the combustion chamber 12, the fan housing 36 excluding the wall of the fan housing 36 containing the inlet port 70, and the remainder of the exhaust system after the fan housing 36.

Located in the conduit 68 is a damper 76 which functions to block the flow of gases in the exhaust system. Also positioned in the conduit 68 just upstream from the damper 76 is a thermostat 78 or other heat sensitive device to register the temperature of the exhaust gas stream at that point.

The apparatus 10 is preferably mobile and for this reason is mounted on a wheeled carriage 80. Other modes of transportation may be used or the apparatus 10 may be kept fixed in position if preferred. Vehicle 80 includes a concrete base and the exhaust chamber 32 is raised therefrom for circulation purposes.

For start up purposes an igniter 82 is connected to the combustion chamber 12. In this embodiment the igniter 82 is a propane gas supply which feeds a burner 84 mounted in the wall of the combustion chamber 12.

In operation the damper 66 is closed and the damper 76 is opened while the fan in the fan housing 36 is running so as to generate a gas flow from the air intake gap 28 at the top of the combustion chamber 12 to the exhaust outlet (not shown).

The fan creates a downward draft in the combustion chamber 12 which exits the combustion chamber 12 at the bottom opening 18. A state of combustion is maintained in the chamber 12 and additional agricultural waste is added to the chamber 12 as the waste is consumed. The heat and gases of the combustion tend to rise but the downward draft forces them to recirculate back into the fire and, with the additional oxygen containing air, intensifies the combustion producing almost complete combustion and relatively little solid combustion products. The intensity of the fire can be regulated by adjusting the air intake 28 using the bolts 30 or by adjusting the fan speed. With proper conditions a temperature of 1500° F. at the filter 52 is attainable for the hot exhaust gases coming from the bottom opening 18 while a pure white powdery ash in small quantities is the solid byproduct of the combustion.

The hot gas stream exiting the combustion chamber 12 is drawn into the exhaust system where it first passes through the exhaust chamber 32. The exhaust chamber 32 acts as a trap for a portion of the solid combustion products which settle from the gas stream and fall from the bottom combustion chamber opening 18. Periodically, the access port 42 is opened and the exhaust chamber 32 is cleaned out.

The tower 34 is spaced from the bottom combustion chamber opening 18 so as to give solid particles an opportunity to fall from the gas stream as they traverse the exhaust chamber 32. Upon entering the first vertical portion 44 of the tower 34, the gas stream travels upwardly so that further solid combustion products will be forced to settle from the gas stream falling backward into the exhaust chamber 32. To insure a thoroughly cleaned gas stream, the filter 52, the cinders or clinkers 56 of which are kept in a constant state of agitation by the force of the gas below, acts to trap any upwardly traveling particles.

The clean stream of hot exhaust gases then flows downwardly in the second vertical portion 46 of the tower 34 and enters the generally horizontal conduit 68 before entering the fan housing 36. The temperature sensor 78 measures the temperature of the stream of hot gases as it approaches the fan housing 36 and depending on that reading and the desired temperature of the gas stream at the exhaust outlet, the inlet port cover 72 is adjusted accordingly either manually or through an automatic mechanical linkage so that either greater or lesser amounts of cooler air may be drawn into the fan housing to mix with the gases being drawn from the combustion chamber 12 to regulate the final temperature of the gas stream at the exhaust outlet. As discussed previously this cooler air is preferably taken from air space within the housing 74 but may be drawn directly from the ambient air. If the air is drawn from the air space within the housing 74, an opening (not shown) is provided in the housing 74 to admit ambient air to the housing.

From the fan housing 36 the gas stream is directed to the exhaust outlet from which it may be taken and used for heating purposes requiring a hot gas supply such as in a grain drying operation, a forced air heating system, a Sterling engine, which then can be run as a generator to produce electricity, or a heat exchanger where the heat is transferred to heat water which is in turn used for heating purposes.

During start up of the apparatus 10 when combustion is first being generated in the chamber 12 by the igniter 82, it may be undesirable to allow the exhaust gases to travel through the exhaust system to the exhaust outlet due to the possible presence of large amounts of solid combustion products resulting from the at first incomplete combustion and due to the relatively cool temperature of the gas stream. During start up therefore the damper 66 is opened and the damper 76 is closed while the fan 64 rather than the fan in the housing 36 is turned on. The igniter 82 is then applied to the waste in the combustion chamber 12 for 5 minutes while the exhaust gases are being directed into the bypass conduit 58 and ejected from the heater. The main fan is then turned on and the damper 76 slowly opened over a period of 4 to 5 minutes after which the damper 66 is closed and the fan 64 is turned off. Finally the igniter 82 is turned off.

While this invention has been described as having a preferred design, it will be understood that it is capable of further modification. This application is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What we claim is:

1. An agricultural waste burning heater, comprising:

a generally vertically disposed agricultural waste combustion chamber having an opening at the bottom thereof, and an openable and closable access means at the top thereof for the addition of agricultural waste to said combustion chamber, a generally cylindrical upper portion, and a generally conical lower portion, said conical lower portion tapering downwardly toward said bottom opening with the interior of said conical lower portion being lined with firebrick;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber; and, gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet.

2. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet; and, said exhaust system also including a conduit connecting said bottom opening of said combustion chamber with said exhaust outlet, said conduit including a first portion which is generally vertically disposed through which the exhaust gases flow upwardly so that, while the gas stream rises in said first vertical portion, solid combustion products will settle from the stream and a second portion which is generally vertically disposed located in said conduit after said first vertical portion and through which the exhaust gases flow downwardly.

3. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet; and, said exhaust system also including an exhaust chamber at the base of said combustion chamber into which said bottom opening of said combustion chamber feeds and in which solid combustion products settle and a conduit connecting said exhaust chamber with said exhaust outlet, said conduit including a first portion which is generally vertically disposed through which the exhaust gases flow upwardly so that, while the gas stream rises in said first vertical portion, solid combustion products will settle from the stream and a second portion which is generally vertically disposed located in said conduit after said first vertical portion and through which the exhaust gases flow downwardly.

4. A heater according to claim 3 wherein said first generally vertical portion of said exhaust conduit connects directly to said exhaust chamber so that solid combustion products settling from said first vertical portion will fall into said exhaust chamber.

5. A heater according to claim 2, 3 or 4 wherein said first and second generally vertical portions are situated adjacent to one another and are connected by a semicircular shaped conduit member.

6. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet;

said exhaust system also including a conduit connecting said bottom opening of said combustion chamber with said exhaust outlet, said conduit including a portion which is generally vertically disposed through which the exhaust gases flow upwardly so that, while the gas stream rises in said vertical portion, solid combustion products will settle from the stream; and, said filtration means being located in said generally vertical portion of said exhaust conduit and comprising a generally horizontally disposed support having a layer of filtration material thereon for removing from the gas stream solid combustion products.

7. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet;

said exhaust system also including an exhaust chamber at the base of said combustion chamber into which said bottom opening of said combustion chamber feeds and in which solid combustion products settle and a conduit connecting said exhaust chamber with said exhaust outlet, said conduit including a portion which is generally vertically disposed through which the exhaust gases flow upwardly so that, while the gas stream rises in said vertical portion, solid combustion products will settle from the stream; and, said filtration means being located in said generally vertical portion of said exhaust conduit and comprising a generally horizontally disposed support having a layer of filtration material thereon for removing from the gas stream solid combustion products.

8. A heater according to claim 7 wherein said generally vertical portion of said exhaust conduit connects directly to said exhaust chamber so that solid combustion products settling from said vertical portion will fall into said exhaust chamber.

9. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet, a conduit connecting said bottom opening of said combustion chamber with said exhaust outlet, and a filtration means between said bottom opening of said combustion chamber and said exhaust outlet for removing solid products of combustion;

air intake means in the upper part of said combustion chamber for permitting air flow into said combustion chamber; and, a fan, situated in said conduit in a fan housing of greater cross sectional area than that of said exhaust conduit, for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet.

10. A heater according to claim 9 wherein said exhaust system also includes air mixing means for mixing cooler air with the hot gases coming from said combustion chamber to regulate the final temperature of the gas stream at said exhaust outlet, said air mixing means including an inlet port in said fan housing through which said fan draws the cooler air into said fan housing while drawing the exhaust gas stream into said fan housing, said air mixing means also including an inlet port cover for varying the size of the inlet port opening.

11. A heater according to claim 10 wherein said inlet port surrounds said exhaust conduit at its point of connection with said fan housing and said inlet port cover is an annular member mounted about said exhaust conduit, said port cover being longitudinally movable along said conduit to vary the size of the inlet port opening.

12. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet; and, said exhaust system also including air mixing means for mixing cooler air with the hot gases coming from said combustion chamber to regulate the final temperature of the gas stream at said exhaust outlet.

13. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet; and, a housing about at least a portion of said heater to create an air space which functions to trap escaping heat.

14. A heater according to claim 12, 10 or 11 wherein said heater includes a housing about at least a portion of said heater to create an air space which functions to trap escaping heat an wherein said air mixing means draws the cooler air from said air space.

15. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet and a filtration means between said bottom opening of said combustion chamber and said exhaust outlet for removing solid products of combustion;

air intake means in the upper part of said combustion chamber for permitting air flow into said combustion chamber;

gas flow means for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is usable for heating purposes upon leaving said exhaust outlet; and, bypass conduit means for directing the gas stream from said combustion chamber outside said heater during start up of said heater, said bypass conduit means being connected to said exhaust system.

16. A heater according to claim 6, 7 or 8 and including a bypass conduit means for directing the gas stream from said combustion chamber outside said heater during start up of said heater, said bypass conduit means being connected to said exhaust system at said generally vertical portion between said filtration means and the top of said generally vertical portion.

17. A method for burning agricultural waste for heating purposes, comprising the steps of:

placing agricultural waste in a combustion chamber having an opening at the bottom thereof and air intake means in the upper part thereof;

buring the agricultural waste;

maintaining a downward draft in said combustion chamber while the agricultural waste is burning;

removing solid combustion products from the resultant exhaust gas stream coming from said bottom opening of said combustion chamber;

using the exhaust gas stream for heating purposes; and, feeding the exhaust gas stream to a bypass conduit for disposal during the start up of the combustion.

18. A method for burning agricultural waste for heating purposes, comprising the steps of:

placing agricultural waste in a combustion chamber having an opening at the bottom thereof and air intake means in the upper part thereof;

burning the agricultural waste;

maintaining a downward draft in said combustion chamber while the agricultural waste is burning;

removing solid combustion products from the resultant exhaust gas stream coming from said bottom opening of said combustion chamber;

mixing cooler air with the exhaust gas stream for regulating the temperature of the exhaust gas stream; and, using the exhaust gas stream for heating purposes.

19. An agricultural waste burning heater, comprising:

an agricultural waste combustion chamber having an opening at the bottom thereof and an openable and closable access means at the top thereof for the addition of agricultural waste to said combustion chamber;

means for supporting the waste in said combustion chamber while permitting gas flow through said combustion chamber;

an exhaust system connected to said bottom opening, said exhaust system including an exhaust outlet, a conduit connecting said bottom opening of said combustion chamber with said exhaust outlet, and a filtration means between said bottom opening of said combustion chamber and said exhaust outlet for removing solid products of combustion;

air intake means in the upper part of said combustion chamber for permitting air flow into said combustion chamber; and, fan means situated in said conduit for creating a downward draft in said combustion chamber which exits said combustion chamber at said bottom opening and passes through said exhaust system to said exhaust outlet whereby agricultural waste burned in said combustion chamber while being subjected to the downward draft is almost completely combusted producing a stream of hot gases which is useful for heating purposes upon leaving said exhaust outlet.

20. A heater according to claim 19 wherein said exhaust system includes an exhaust chamber at the base of said combustion chamber into which said bottom opening of said combustion chamber feeds and said exhaust system conduit includes a portion which is generally vertically disposed, said conduit portion being directly connected to said exhaust chamber at a location spaced from said combustin chamber bottom opening whereby, while the stream of hot gases exiting from said combustion chamber bottom opening passes through said exhaust chamber and then flows upwardly in said conduit portion, solid combustion products settle from the gas stream in said exhaust chamber and as the gas stream passes upwardly in said conduit portion so as to fall into said exhaust chamber.

* * * * *